US006514587B1

(12) United States Patent
Fernandez-Kirchberger et al.

(10) Patent No.: US 6,514,587 B1
(45) Date of Patent: Feb. 4, 2003

(54) SET FOR LAMINATION OF A PRINT CARRIER WITH A PROTECTIVE ELEMENT

(75) Inventors: Paul Fernandez-Kirchberger, Berg (DE); Maximilian R. Seidl, Munich (DE)

(73) Assignee: Promaxx Inovative PC Print Media GmbH, Munich (DE)

( * ) Notice: Subject to any disclaimer, the term of this patent is extended or adjusted under 35 U.S.C. 154(b) by 0 days.

(21) Appl. No.: 09/466,043

(22) Filed: Dec. 17, 1999

(51) Int. Cl.[7] ..... B42D 15/00

(52) U.S. Cl. ..... 428/40.1; 283/81; 283/98; 283/105; 283/106; 283/109; 428/41.7; 428/42.2; 428/42.3; 428/43; 428/124; 428/125

(58) Field of Search ..... 428/40.1, 43, 41.7, 428/42.2, 42.3, 124, 125; 283/81, 98, 105, 106, 109

(56) References Cited

U.S. PATENT DOCUMENTS 5,058,926 A * 10/1991 Drower ..... 283/109
5,135,789 A * 8/1992 Schmidt ..... 428/42.1
5,230,938 A * 7/1993 Hess ..... 428/42.1
5,705,243 A * 1/1998 Mehta ..... 428/40.1

* cited by examiner

*Primary Examiner*—Nasser Ahmad
(74) *Attorney, Agent, or Firm*—Muramatsu & Associates

(57) ABSTRACT

A lamination set with a supporting sheet, a print carrier and a protective element. The print carrier and the protective element are completely stamped out from the supporting sheet and held on the supporting sheet by adhesive strips in such a way that the protective element and the print carrier can be folded relative to one another about a folding axis, so that the print carrier is laminated with the protective element. The print carrier and the protective element are held spaced from one another on the supporting sheet and the folding axis about which the protective element can be folded relative to one another is formed in the supporting sheet.

14 Claims, 5 Drawing Sheets

SET FOR LAMINATION OF A PRINT CARRIER WITH A PROTECTIVE ELEMENT

FIELD OF THE INVENTION

The invention relates to a set for lamination of a print carrier with a protective element.

BACKGROUND OF THE INVENTION

Identity cards in check card format are used in the art in the most varied forms. In general, variable data (name, etc.) are recorded manually or by means of a printer. After the card has been printed or written on, however, it should be extremely abrasion-resistant. This is usually achieved by sealing the card with a transparent protective film.

The most varied methods for doing this are known in the art. Thus for example there are so-called sealing pockets or cards with folded lamination, but with these an unattractive transparent edge remains around the actual print carrier.

A set is also known which has a supporting sheet, a print carrier, a transparent protective film with adhesive layer and a cover element which covers the adhesive layer of the protective film. The print carrier and the protective film with cover element are retained on the supporting sheet in such a way that, after removal of the covering material, the protective film and the print carrier can be folded about an axis relative to one another, so that the print carrier is laminated with the protective film.

The print carrier and the protective film with cover element are disposed side by side in a cut-out in the supporting sheet and are releasably fixed by an adhesive film provided on the reverse face. The protective film likewise extends over the entire cut-out and is already firmly connected to the reverse face of the print carrier. The remaining part of the protective film is initially covered by the cover element. After the print carrier has been printed or written on, the cover element is removed and the print carrier is folded about its edge which directly adjoined the cover element which was removed.

Thus the front face of the print carrier can also come into contact with the protective film, so that both faces of the print carrier are laminated with the protective film.

However, this method has the disadvantage that the edge region about which the print carrier is folded is also sealed, whilst the edge regions of the other three sides are open.

During lamination of the print carrier, first of all, the print carrier must be detached from the adhesive film at the end remote from the actual folding axis in order that it may then be folded about one of its edges. In this folding process it is necessary to proceed very carefully in order to avoid creasing of the protective film or crooked application of the protective film.

SUMMARY OF THE INVENTION

The object of the invention therefore is to provide an improved set for lamination of a print carrier which is easy and secure to handle.

According to the invention the set has a supporting sheet, a print carrier and a protective element, the print carrier and the protective element being held on the supporting sheet in such a way that the protective element and the print carrier can be folded relative to one another about a folding axis, so that the print carrier is laminated with the protective element. In this case the print carrier and the protective element are held spaced from one another on the supporting sheet and the folding axis is formed in the supporting sheet.

In a preferred embodiment, the print carrier and the protective element as well as the folding axis are produced with one stamping tool in one operation.

In the print carrier which is laminated according to the invention, the protective element merely covers one face of the print carrier, whilst all edge regions remain free.

In a further embodiment, the print carrier is formed by a back-lit film, the print carrier and the protective element being disposed in the set in such a way that the face of the back-lit film which can be printed on can be laminated by the protective element.

Further advantages and embodiments of the invention are explained in greater detail with reference to the description of some embodiments and the drawings.

DETAILED DESCRIPTION OF THE INVENTION

The set according to a first embodiment which is shown in FIGS. 1*a* to 1*d* essentially comprises a supporting sheet 1.1, a print carrier 2.1 and a protective element 3.1. The print carrier 2.1 and the protective element 3.1 are held on the supporting sheet 1.1 in such a way that the print carrier and the protective element can be folded relative to one another about an axis 4.1, the print carrier being laminated with the protective element. The print carrier 2.1 and the protective element 3.1 are held at a spacing a from one another on the supporting sheet 1.1. The axis 4.1 is formed in the supporting sheet.

Figure 1A:
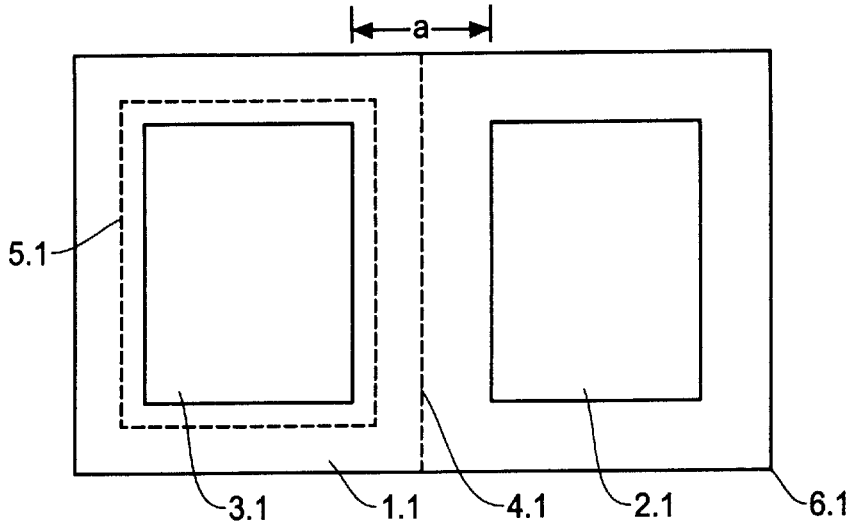
FIGS. 1*a*–1*d* show various views of the set according to a first embodiment according to the invention.
Figure 1B:
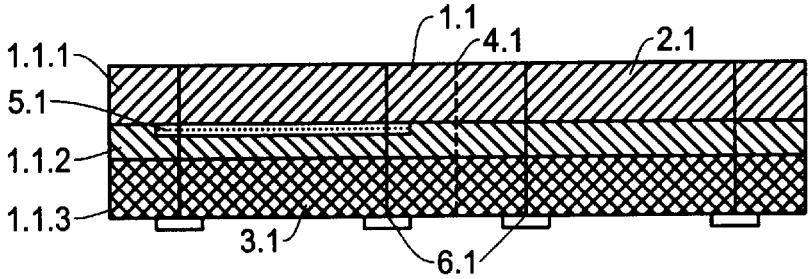

In the top view shown in FIG. 1*a,* the print carrier 2.1 and the protective element 3.1 correspond in shape and dimensions and are disposed symmetrically with respect to the axis 4.1. The construction of this set is shown even more clearly in the sectional representations according to FIGS. 1*b* and 1*c*.

In the illustrated embodiment, the supporting sheet 1.1 has a three-layer construction, the print carrier 2.1 and the protective element 3.1 being formed by parts of the supporting sheet which are completely stamped out.

The supporting sheet 1.1 has a layer of material 1.1.1 which can be printed on, an adhesive layer 1.1.2 and a protective film 1.1.3. Within the scope of the invention, the adhesive layer 1.1.2 and the protective film 1.1.3 can also be formed by another transparent protective laminate.

In the region of the protective element 3.1, between the adhesive layer 1.1.2 and the layer of material 1.1.1 which can be printed on, a cover element 5.1 is provided which is formed for example by a silicone strip which is fixed on the layer of material 1.1.1 which can be printed on before the application of the adhesive layer 1.1.2.

The protective element 3.1 and the print carrier 2.1 are produced by stamping out of the supporting sheet. The supporting sheet, print carrier and protective element are held together by a narrow adhesive strip 6.1 on the underside of the set. Instead of the narrow adhesive strip 6.1, an adhesive film over the whole surface could also be used. However, the crucial point is that the print carrier 2.1 or the protective element 3.1 can be detached without problems from the adhesive strips 6.1 or from an adhesive film.

In the middle between the print carrier 2.1 and the protective element 3.1 the axis 4.1 is formed for example by a kink perforation. Within the scope of the invention, it would also be possible for the supporting sheet to be divided along the axis 4.1 by stamping out into two parts which are held together by an adhesive strip.

Since the print carrier and the protective element as well as the axis are produced with one stamping tool and in one operation it is ensured that proper lamination of the print carrier is achieved with a relative folding movement of the protective element and the print carrier about the axis 4.1.

Figure 1C:
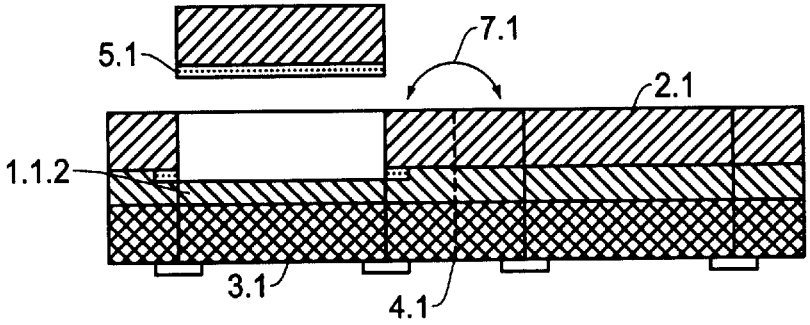
Figure 1D:
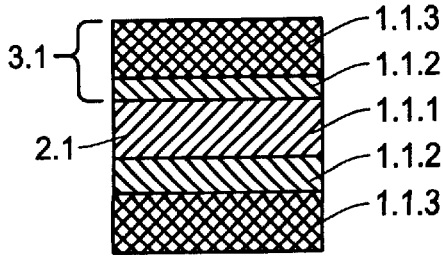

Before the print carrier 2.1 is laminated with the protective element 3.1, in the illustrated embodiment, the cover element 5.1 must be removed as shown in FIG. 1*c*, thus exposing the underlying adhesive layer 1.1.2 of the protective element 3.1. Then the protective element 3.1 and the print carrier 2.1 can be folded relative to one another about the axis 4.1, as is indicated by the arrow 7.1.

The print carrier laminated in this way can then be removed from the supporting sheet 1.1. The resulting laminated print carrier 2.1 is shown again in FIG. 1*d*. The surface of this print carrier which can be printed on or is printed on is covered by the protective element 3.1.

Since both the print carrier and the protective element have been formed by stamping out from a sheet of material 1.1, the print carrier 2.1 is provided on both sides with an adhesive layer 1.1.2 and the protective film 1.1.3.

All further embodiments according to FIGS. 2 to 5 correspond in their arrangement of print carrier, protective element and the axis on the supporting sheet. The differences are merely in the construction of the individual elements which are apparent in each case from the sectional representations.

In the embodiment according to FIGS. 2*a* to 2*d* the print carrier and the protective element are again formed by stamping out in a supporting sheet which is formed by a back-lit film.

A back-lit film consists as a rule of a transparent PET film 1.2.1 and a coating 1.2.2. which is applied to one face of this film and can be printed on.

In the region of the protective element 3.2, the set has a double-sided adhesive strip which is covered on the upper face by a cover element 5.2. Otherwise the print carrier and the protective element together with the double-sided adhesive strip and the cover element are stamped out of the supporting sheet, the individual components being held together by way of adhesive strips 6.2.

Figure 2A:
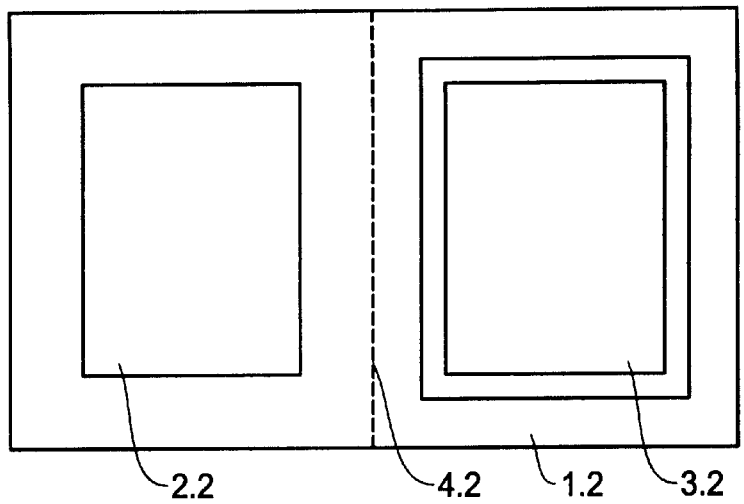
FIGS. 2*a*–2*d* show various views of the set according to a second embodiment according to the invention.
Figure 2B:
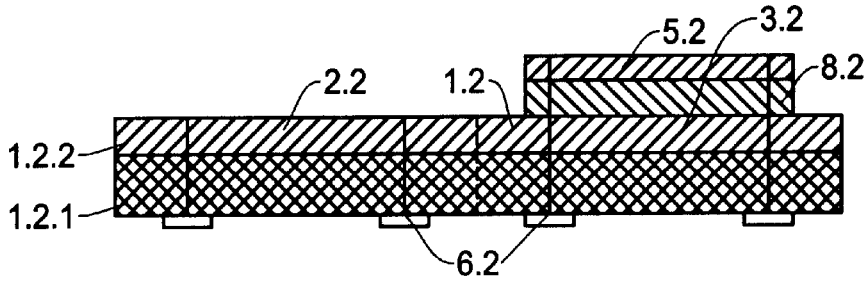
Figure 2C:
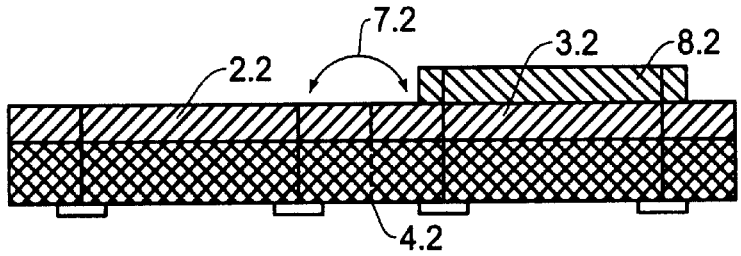

In the region of the print carrier 2.2. on the layer 1.2.2. which can be printed on, the set illustrated in FIG. 2*b* can then be printed on for example in a desktop printer.

For lamination of the print carrier 2.2, the cover element 5.2 is then removed so that the print carrier 2.2 and the protective element 3.2 can be folded towards one another (arrow 7.2) about the axis (4.2). In this case the double-sided adhesive strip 8.2 comes into contact with the printed layer of the print carrier 2.2.

Figure 2D:
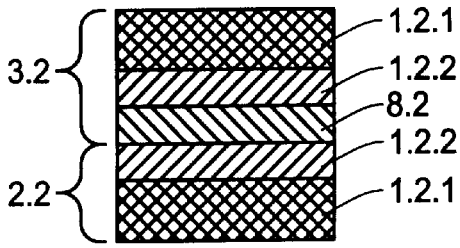

The print carrier laminated in this way can then be released from the set which then has the construction shown in FIG. 2*d*. Back-lit films are printed on the printable layer 1.2.2 in mirror inversion, so that the print can be viewed from the correct side through the PET film 1.2.1.

Figure 3A:
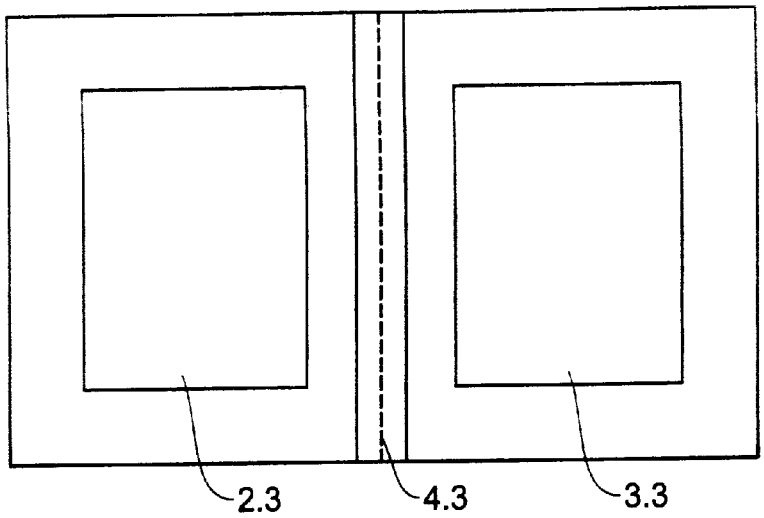
FIGS. 3*a*–3*c* show various views of the set according to a third embodiment according to the invention.
Figure 3B:
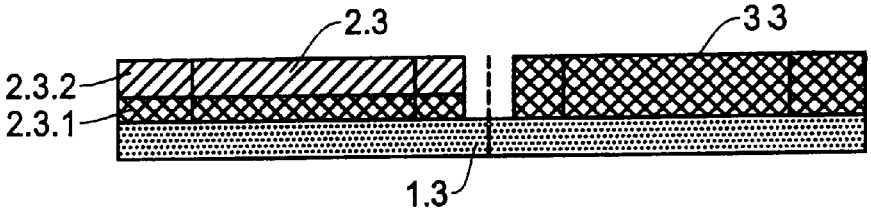
Figure 3C:
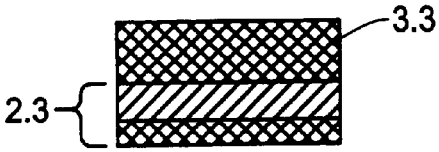
Figure 4A:
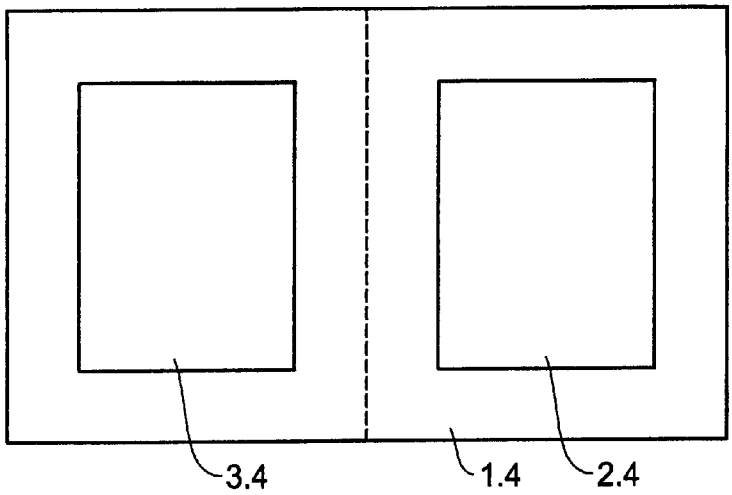
FIGS. 4*a*–4*e* show various views of the set according to a fourth embodiment according to the invention.
Figure 4B:
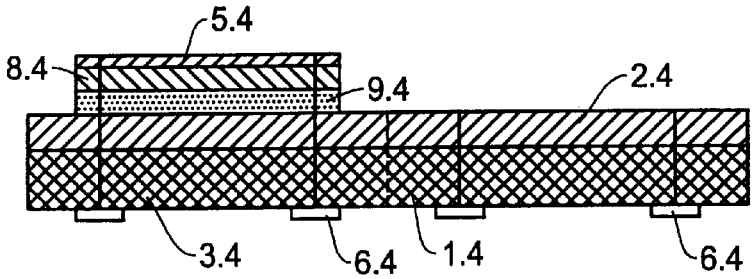
Figure 4C:
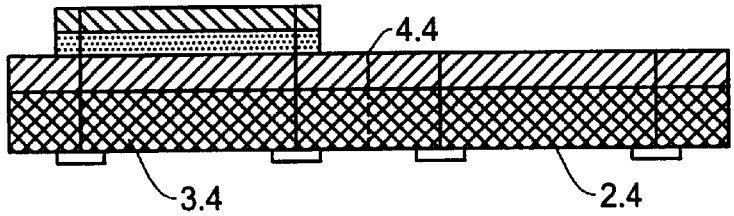
Figure 4E:
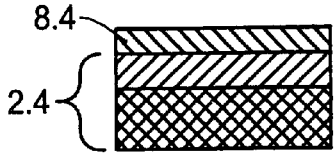
Figure 4D:
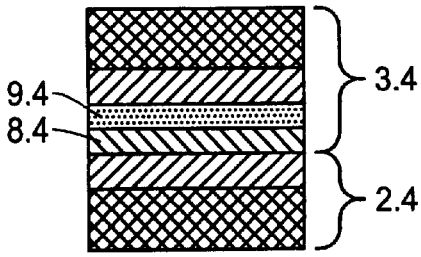

In the embodiment according to FIG. 3, on a supporting sheet 1.3, a print carrier 2.3 is held on one side of the axis 4.3 and a protective element 3.3 is held on the other side. The print carrier 2.3 is again formed by a back-lit film which consists of a PET film 2.3.1 and a printable layer 2.3.2. The protective element 3.3 is formed by a heat-sealable coating.

The print carrier 2.3 is completely stamped out from the back-lit film. In a corresponding manner, the protective element 3 is stamped out from the heat-sealable coating. The print carrier and the protective element are held together by the supporting sheet 1.3. In this case a layer of contact adhesive (not shown), from which the print carrier and the protective element can be removed without residue, serves for example as the connection.

During the stamping process the axis 4.3 is again formed about which the print carrier and the protective element can be folded relative to one another. After they have been folded together the protective element is permanently connected to the print carrier by heat sealing.

In FIG. 4, a fourth embodiment is shown in which the supporting sheet is again constructed as a back-lit film which in the region of the protective element 3.4 is provided on the printable coating first of all with a thin siliconized strip 9.4 and on top of that a double-sided adhesive strip 8.4, the double-sided adhesive strip 8.4 again being provided with a cover element 5.4.

The print carrier 2.4 and the protective element 3.4 are again completely stamped out of the supporting sheet 1.4, the print carrier and the protective element being held by way of adhesive strips 6.4 on the supporting sheet. The print carrier 2.4 can then again be printed on in mirror inversion. After removal of the cover element 5.4, the set can be folded about the axis 4.4 so that the protective element 3.4 is connected with its double-sided adhesive strip 8.4 to the print carrier 2.4. The resulting laminated print carrier (see FIG. 4*d*) can be detached from the set.

The special feature of the laminated print carrier resides in the fact that due to the siliconized strip 9.4, the protective element 3.4 can be removed as far as the double-sided adhesive strip 8.4 (see FIG. 4*e*) This produces a self-adhesive label, the printed surface of which is protected.

Figure 5A:
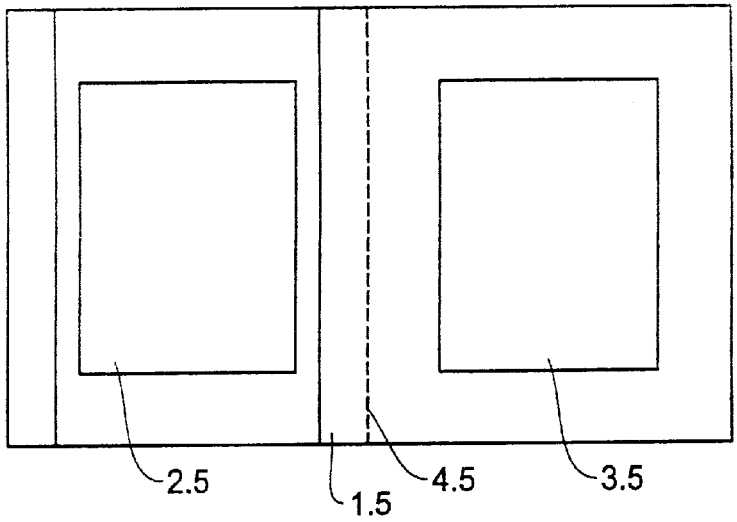
FIGS. 5*a*–5*c* show various views of the set according to a fifth embodiment according to the invention.
Figure 5B:
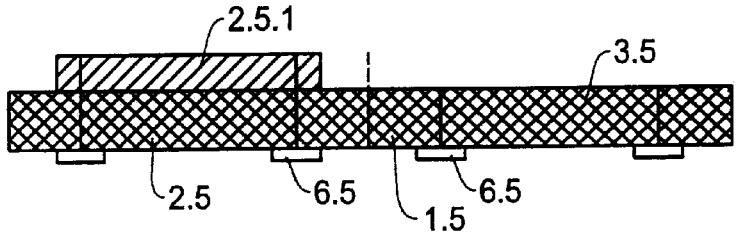
Figure 5C:
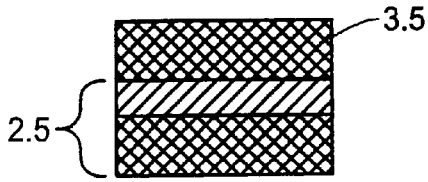

In the embodiment according to FIG. 5, the supporting sheet 1.5 is formed by a hot laminate film which is provided with a printable coating 2.5.1 in the region of the print carrier 2.5. The print carrier, which is again completely stamped out, as well as the protective element are held on the supporting sheet 1.5 by way of adhesive strips 6.5. The axis 4.5 which is likewise formed in the stamping operation makes it possible for the protective element and the print carrier to be folded relative to one another about the axis, so that the print carrier is laminated with the protective element.

In all the embodiments described above, the print carrier and the protective element are held spaced from one another on the supporting sheet, and the axis about which the print carrier and the protective element can be folded relative to one another is formed in the supporting sheet.

What is claimed is:

1. A lamination set for laminating printed material for protection, comprising:

a supporting sheet, adhesive means which is detachably attached to the supporting sheet, a print carrier formed on the supporting sheet for printing or writing information thereon, the print carrier being already provided with a protective film on its face which cannot be printed on, and the print carrier being completely stamped out from the supporting sheet and held on the supporting sheet by the adhesive means, a protective element which is transparent and formed on the supporting sheet, the protective element being completely stamped out from the supporting sheet and held on the supporting sheet by the adhesive means, wherein the print carrier and the protective element are held on the supporting sheet in such a way that the protective element and the print carrier can be folded relative to one another about a folding axis, so that the print carrier is laminated with the protective element, and wherein the print carrier and the protective element are held spaced from one another on the supporting sheet and the folding axis is formed in the supporting sheet at about a center thereof.

2. A lamination set as claimed in claim 1, wherein the print carrier is held in a corresponding cut-out in the supporting sheet.

3. A lamination set as claimed in claim 1, wherein the print carrier and the protective element as well as the folding axis are produced with one stamping tool in one operation.

4. A lamination set as claimed in claim 1, wherein the folding axis is formed in the supporting sheet by a kink perforation.

5. A lamination set as claimed in claim 1, wherein the supporting sheet is divided along the folding axis into two parts which are held together by the adhesive strip.

6. A lamination set as claimed in claim 1, wherein the print carrier and the protective element are each held in a cut-out created in the supporting sheet.

7. A lamination set as claimed in claim 1, wherein the print carrier and the protective element are held in corresponding cut-outs created in the supporting sheet by means of the adhesive strips.

8. A lamination set as claimed in claim 1, wherein the adhesive means for holding the print carrier and the protective element which are completely stamped out in the supporting sheet are adhesive films.

9. A lamination set as claimed in claim 1, wherein the adhesive means for holding the print carrier and the protective element which are completely stamped out in the supporting sheet are adhesive strips.

10. A lamination set as claimed in claim 1, wherein the print carrier is formed by a back-lit film.

11. A lamination set as claimed in claim 1, wherein for connection of the print carrier and the protective element during lamination, the protective element is provided with an adhesive layer.

12. A lamination set as claimed in claim 1, wherein for connection of the print carrier and the protective element during lamination, the protective element has a coating which can be hot laminated.

13. A lamination set as claimed in claim 1, wherein a cover element is also provided which covers the protective element and can be removed for lamination.

14. A lamination set as claimed in claim 1, wherein the print carrier and the protective element correspond in shape and dimensions and are disposed symmetrically with respect to the folding axis.

* * * * *